US005143653A

United States Patent [19]

Magnin et al.

[11] Patent Number: 5,143,653

[45] Date of Patent: Sep. 1, 1992

[54] PROCESS FOR IMMOBILIZING RADIOACTIVE ION EXCHANGE RESINS BY A HYDRAULIC BINDER

[75] Inventors: Guy Magnin; Marie-Francoise Magnin, both of Le Havre; Veronique Aubert, Rambouillet, all of France

[73] Assignee: Societe Anonyme: Societe Generale pour les Techniques Nouvelles-SGN, Cedex, France

[21] Appl. No.: 675,756

[22] Filed: Mar. 19, 1991

Related U.S. Application Data

[63] Continuation-in-part of Ser. No. 314,828, Jan. 12, 1989, abandoned.

[51] Int. Cl.[5] ..... G21F 9/16

[52] U.S. Cl. ..... 252/628; 252/631; 210/751; 210/682; 210/710

[58] Field of Search ..... 252/628, 631; 106/90; 210/682, 710, 751

[56] References Cited

U.S. PATENT DOCUMENTS

| | | | |
|---|---|---|---|
| 4,122,028 | 10/1978 | Iffland et al. | 252/628 |
| 4,500,449 | 2/1985 | Kuhnke et al. | 252/628 |
| 4,530,723 | 7/1985 | Smeltzer et al. | 106/90 |
| 4,620,947 | 11/1986 | Carlson | 252/628 |
| 4,663,086 | 5/1987 | Le Fillatre | 252/628 |
| 4,671,897 | 6/1987 | Mori et al. | 252/628 |
| 4,671,898 | 6/1987 | Hultgren | 252/628 |
| 4,800,042 | 1/1989 | Kurumada et al. | 252/628 |

FOREIGN PATENT DOCUMENTS

| | | |
|---|---|---|
| 0157683 | 10/1985 | European Pat. Off. . |
| 2603116 | 8/1977 | Fed. Rep. of Germany . |
| 2827030 | 1/1979 | Fed. Rep. of Germany . |
| 2333331 | 6/1977 | France . |

*Primary Examiner*—Brooks H. Hunt
*Assistant Examiner*—Ngoclan T. Mai
*Attorney, Agent, or Firm*—Louis Weinstein

[57] ABSTRACT

The invention relates to a process for immobilizing, by an hydraulic binder, radioactive ion exchange resins or IER, which can contain borates in a quantity which can reach up to the equivalent of 1000 g $H_3BO_3$/kg of dry IER, wherein the IER are decanted and then placed in contact for a maximum of three hours with an eluant solution of 100 to 300 g/l in $Ca(NO_3)_2$ in the proportion of 1 to 2 l/kg of decanted IER, an hydraulic binder of low hydration heat being added to the medium of pH≧9 so that the ratio of the water of the eluant solution to the binder (by weight) is between 0.3 and 0.5 and that the incorporation rate:dry IER/final product (by weight) is between 3% and 10%.

13 Claims, No Drawings

PROCESS FOR IMMOBILIZING RADIOACTIVE ION EXCHANGE RESINS BY A HYDRAULIC BINDER

This application is a continuation-in-part of U.S. application Ser. No. 314,828, filed Jan. 12, 1989, now abandoned.

The present invention relates to a process for the immobilization of radioactive ion exchange resins (IER) by means of an hydraulic binder.

The radioactive IER to be treated originate essentially from nuclear reactors in which they are used for purifying the water of the different circuits of the reactor, and in some cases, for purifying the water of pools used for storing irradiated fuel elements. In particular, in pressurized-water reactors or PWR, anionic IER are placed in the primary circuit of which the water contains boric acid acting as a moderator.

The anionic IER can then serve as "boron lungs" to keep up the required boron concentration inside the circuit.

Nuclear power station operators consider that the waste IER can contain, in borates form, up to the equivalent of 1000 g of boric acid per kg of dry IER.

Besides borates, these IER (cationic, anionic, mixed bed) can contain lithium, ammonium, iron, cobalt, chromium, nickel and cesium cations and hydroxide, sulphate, phosphate, silicate, fluoride, chloride, and bicarbonate anions.

Some IER are also used in installations for reprocessing irradiated fuel elements, for purifying the water of storage pools and for treating liquids.

The IER are placed in columns or cartridges.

At the moment, they are regenerated on the spot before immobilization. Then, they essentially contain $H^+$, $OH^-$ and non-eluted active metallic cations.

To prevent dissemination of radioactive substances in the environment, it is sought to immobilize the wastes containing such substances, in a matrix capable of resisting mechanical, chemical or other agents liable to damage it during storage of said wastes.

One way of doing this consists in mixing said wastes with an hydraulic binder which, by setting and subsequently hardening, confers a certain mechanical resistance to the mixture and a certain resistance against chemical attacks.

The values of such mechanical and chemical resistances which the immobilized waste (also called final product or coated product) should reach, in order to be stored with all the safety guarantees required for man and environment, are fixed by the nuclear safety standards.

Said standards are set by the national authorities and can consequently vary from one country to another.

French safety standards concerning wastes immobilized in an hydraulic binder are among the strictest: few countries have succeeded in reaching such standards with wastes containing IER. For example, in France, since 1982, the concreting of IER has been discontinued because the methods used do not give final products meeting the safety requirements.

Indeed, the treatment of IER with an hydraulic binder raises two essential problems which do not arise with other types of nuclear wastes.

The first problem is that of ion exchange between the IER and the medium containing the hydraulic binder.

The ions of the medium which have a greater affinity for the IER than the affinity which the ions contained in these IER have for them, settle on the IER in the place of the ions which they used to contain, which latter have been salted out into the medium. There is fixation of ions and simultaneously salting-out of other ions. As a result, the medium loses ions from the hydraulic binder ($Ca^{++}$ and $SO_4^{=}$ essentially) but, on the other hand, gains ions originating from the nuclear installations (active metallic cations, phosphates, sulphates . . . $H^+$, $OH^-$ and borates).

The loss of binder ions, and in particular $Ca^{++}$ and $SO_4^{--}$, alters the setting (delay, uncontrollability, incomplete setting). Moreover, the ions brought by the IER and salted out into the medium can interfere with the setting or hardening or they can affect the stability in time of the immobilized wastes.

$Zn^{++}$ has a setting- retardant or inhibitor action;

$Mg^{++}$ can interchange with $Ca^{++}$ of the calcium hydrates, after setting, and therefore modify the stability in time of the product;

$H^+$ the binder hydration reactions occur in basic medium, a reductin of the pH to acid values retards, if not inhibits the setting;

the phosphates also have an inhibiting effect on the setting.

The ions which, by far, create the greatest problems are the borates. Their effect is known on hydraulic binders, and depending on their concentration in the medium, they either retard or inhibit the setting, whether they are in free form or associated with certain ions such as lithium to form $Li_2B_4O_7$.

Ionic exchanges can continue after the setting, particularly during lixiviation tests, between the lixiviating medium and the IER rendered accessible in the coated product through various causes (permeable matrix, bad homogeneity, high porosity, . . . ). The released ions can generate reactions which are harmful to the coated product, this is, for example, the case with sulphates.

The second type of difficulty which is met when treating IER is specifically due to water migration from the IER toward the medium containing the hydraulic binder. The IER release a fraction of their water according to the equilibrium principle between the water of the IER and the water of the medium. The binder hydration reactions being exothermic, water continues to be lost throughout the setting. On completion of the setting, the partly dehydrated particles of IER can, if the final product is placed in contact with water, regain some water.

This is the wellknown phenomenon of swelling and cracking of immersed coated products after setting and even after hardening: the swelling due to the regain of water causes cracking of the material and can result in a complete disintegration of the matter.

Industrial solutions must be found to these two categories of problems, in which solutions:

1) the volume of the coated product to be stored on a long-term basis must be as reduced as possible in order to minimize the costs of storage installations;
2) the immobilization process must be technologically implementable with relatively simple, reliable and quick-acting means.

French Patent FR-A-75 33 518 proposes to adjoin additives whose function is to prevent the water from penetrating into the particles of IER. Such additive substances form a protection layer around the IER particle. They are organic compounds (organic ester, polyvinyl propionate), or mineral compounds (alkaline silicate).

But there is no certainty that any borate ions contained in the IER will not be able to penetrate into the aqueous medium. What is more, this method is not really advantageous because it is expensive and difficult to work.

In order to limit the transfer of water between the IER and the binder during setting, another patent, FR-A-80 21 524 recommends to use blast furnace slag cement in specific conditions and to saturate the IER with water. Set conditions: cement-mixing water/cement (by weight)=0.20 to 0.40, and proportions of incorporation=dry resin/coated product (by weight) $\leqq 15\%$ for a powdered IER and $\leqq 25\%$ for particled IER. It should be specified that the cement-mixing water is the water added to the water-saturated IER to ensure the setting of the cement.

This process does not allow for any possibility of ion exchanges occurring between the cement and the IER. Such a process is not applicable to borate-containing IER: the salted-out borate-containing ions inhibit the setting of the cement in the aforesaid conditions.

Moreover, the solidification by hydraulic binder of borate-containing effluents is known from Patent FR-A-85 04 222 which describes a process in which, before adding the cement, the borate-containing effluents are treated with lime in order to precipitate the calcium borates of predetermined structure in specific conditions.

A solution was then essential for treating the borate-containing IER, consisting in eluting them in order to extract the borate-containing ions therefrom and to replace them in solution, then in separating the IER from the eluting solution, in rinsing in order to remove as much as possible the traces of borates, and finally in concreting the IER on one side and the borate-containing effluents on the other, according to the processes described hereinabove.

Elution of the radioactive IER has already been used before solidification for bituminization or polymerization of a thermosetting resin.

In patent FR-A-76 24 624, the eluting solution is a solution of sodium hydroxide, aqueous ammonia, lime, aluminium chloride, sodium acetate, sodium citrate or sodium oxalate, or else an amine. The obtained IER are decanted or de-watered, then they are mixed with the thermosetting resin of which the polymerization is induced.

This type of treatment causes the elimination from the cationic IER of the $H^+$ ions, which ions have an action on the cross-linking accelerating agent added to the thermosetting resin: $H^+$ ions are extracted from the IER, then placed in solution and separated from said IER.

In patent EP-157 683, elution is achieved with a solution of $Ca^{++}$, $Be^{++}$ or $Sr^{++}$ (nitrate, formiate or acetate anions), the IER are separated from the eluant solution, rinsed, placed in suspension in water and bituminized.

The object of the pre-treatment is to replace the $H^+$, $Na^+$, $OH^-$, $Cl^-$ ions from the IER with the ions from the eluant solution, which latter are more voluminous and modify the tri-dimensional structure of the IER in such a way as to prevent the water from penetrating in the bituminous coated products immersed in the lixiviation medium. In this way, the risks of swelling are extremely reduced.

According to the aforesaid IER treatment processes using an elution in order to eliminate the unwanted ions from the IER—which ions are a hindrance either because of their action on the solidifying medium or because of their ability to induce a regain of water by the IER—said IER are separated from the eluant solution before being immobilized.

It is an object of the present invention to propose a process, applicable on an industrial scale, for treating any IER containing borates, in a single operation, on the same site, and at the same time, with a view to obtaining coated products which meet the standards of safety imposed in the country.

Such process includes a step of pre-treatment by elution followed by a solidifying step by the setting of the hydraulic binder, the elution conditions making it possible to unexpectedly obtain a solidifiable medium such as can be obtained with an hydraulic binder, although containing different ions, such as borates in particular.

More specifically, the object of the present invention is to propose a process for immobilizing, by using an hydraulic binder, radioactive ion exchange resins (IER) which may contain borates in a quantity which can reach up to the equivalent of 1000 g of $H_3BO_3$ per kg of dry IER, wherein the IER are decanted, then placed in contact, for 3 hours or more, with an eluant solution of 100 to 300 g/l $Ca(NO_3)_2$ in the proportion of 1 to 2 l/kg of decanted IER, an hydraulic binder of low hydration heat being added to the medium of $pH \geqq 9$, so that the ratio: water from the eluant solution/binder (by weight) is between 0.3 and 0.5 and the rate of incorporation F'=dry IER/coated product (by weight) is between 3 and 10%. It should be noted that F' differs from F in that F is equal to $$\frac{\text{decanted } IER}{\text{decanted } IER + \text{eluant solution} + \text{hydraulic binder}},$$

wherein $10\% \leqq F \leqq 25\%$ as compared with F' which is $3\% \leqq F' \leqq 10\%$.

The ion exchange resins issued from nuclear installations (i.e. cationic, anionic or in mixed bed) are collected, stored and then sent to the treatment unit. Therefore, generally, nothing is known with precision before the treatment, of their composition, of their nature and of the quantity of ions that they contain.

In any case, it is not easy to give a precise range of values for the borates content, since condensed molecules may have formed and settled. A high content is estimated at 1000 g eq. $H_3BO_3$ so that an average content would be 500 g eq. $H_3BO_3$.

The stored IER are in suspension form. According to the process of the invention, the IER to be treated are first left to decant, and the supernatant is removed (by pumping, etc . . . ). The resulting water-saturated IER (called 100% decanted IER) are then weighed. The weight of 100% decanted IER introduced for treatment will serve as a reference to calculate the quantities of material to be added thereafter.

The object of placing the IER in contact with the eluant solution is:

to fix the ions of the eluant solution on the IER, said ions contributing to helping the immobilization by hydraulic binder;

to place the IER ions in solution, some of which ions hinder the immobilization by hydraulic binder;

to induce precipitation in the solution of said hindering ions in the form of solids which are non-soluble in the conditions of immobilization by hydraulic binder.

The precipitation is combined with the elution, which considerably improves the efficiency of the elution: as the eluted ions precipitate and their concentration in the solution reduces, the balance between the borates in the IER and the borates in solution is shifted.

The selected eluant solution is an aqueous solution of calcium nitrate which induces the precipitation of calcium borates.

The favorable effect of the precipitation on the elution permits a fast contact time : less than 3 hours, and preferably 1 hour.

Said contact time has been determined, together with the quantity equivalents-gms of -g cation or anion, and the quantity of water, both quantities being brought by the eluant solution per kg of IER, from numerous tests carried out by the Applicant.

Indeed, it was not possible to select process values, without knowing either the composition, or the theoretical exchange capacity of the starting IER, or their borates content.

Moreover, the volume of eluant solution introduced for said elution has a direct effect on the next treatment step with the hydraulic binder, the whole volume being kept for that treatment.

Indeed, the ratio of the water of the eluant solution (by weight) to the binder (by weight) has to be kept within strict limits.

As a result, the weight of added binder is dependent on the volume of the eluant solution, the weight of the coated product (binder+eluant solution+IER) being likewise dependent on said volume.

Yet, it is not possible to increase the weight of the coated product inconsiderately without creating handling and storage problems.

It was therefore important to choose the concentration and volume of the eluant solution so that:

the elution is efficient (effective precipitation and fixation);

there is no need to add water in order to obtain the E/C and F ratios;

the weight of the final coated product is not disproportionate;

the volume of solution is not too large, and the elution and treatment with the binder can be carried out in the same apparatus.

Simultaneously, the contact time had to be determined in such a way as to meet the conditions of the process:

adequate elution and precipitation so that the retardant effect on the setting of borates is no longer felt;

industrial requirements : shortest contact time possible in order to produce the largest possible amount of coated products per day.

The experiments conducted by the Applicant show that the optimum is reached with an aqueous solution of $Ca(NO_3)_2$ containing 100 to 300 g/l of calcium nitrate in the proportion of 1 to 2 l/kg of 100% decanted IER and a contact time of 3 hours maximum.

It is obvious that the contact time and the quantity of ions introduced are dependent on the borates content, which, in general, is not known.

The preferred values correspond to coated (i.e. "final") products which are in conformity with the French standards of safety: eluant solution concentration=about 200 g/l; 100% decanted IER=about 1 l/kg; contact time: 1 hour.

The operator is free to choose other values within the ranges allowed by the standards applied in his country: with less strict standards, the operator may, advantageously, reduce the contact time. It is true that the elution is more important with a longer contact time, and then the unwanted ions are blocked in the solution by precipitation.

To increase elution efficiency, lime (preferably in solid form in order not to have to add any water) is advantageously added to the eluant solution, in the proportion of 200 g/kg of 100% decanted IER.

Elution therefore takes place according to a discontinuous process in one single step: the eluant solution is added, under stirring, to the 100% decanted IER. Advantageously, the decanting, elution and treatment by the hydraulic binder are conducted in the same apparatus (mingler-mixer).

It is an important feature of the process to treat the totality of the mixture obtained after the elution step. Indeed, as illustrated in the prior art, when there is elution on the IER, there is after a separation of the IER from the solution.

The low hydration heat hydraulic binder is therefore added under stirring to the mixture obtained as abovedescribed, the medium having a pH at least equal to 9.

Preferably, the binder is a slag cement which, when hard, presents the added characteristic of having a poor porosity and a poor permeability. Slag cements contain variable rates of clinker (the clinker being responsible for the exothermicity of the hydration reaction), by way of example:

In France:

cement: CLK>80% slag, <3% additives

HFC 40 to 75% slag, <3% additives

CLC 20 to 45% slag, <3% additives, 20–45% ashes.

in the U.S.A.: Portland blast furnace cement, 25–65% slag in West Germany: Eisenportland cement>40% slag in Japan: Blast furnace cement type C, 60–70% slag Among the aforesaid cements, those with a high proportion of slag (>60%) are preferred. In France, the choice will go to the CLK type.

Other additives, such as fillers, plasticizers, . . . can be introduced with the hydraulic binder. The basis of the final matrix in which the IER are immobilized is the hydraulic binder, but said matrix can include other elements in lesser proportions.

The added quantity of binder is such that the ratio: water of eluant solution/weight of binder ranges between 0.3 and 0.5 and is preferably 0.4 for a rate of incorporation of IER F'=weight of dry IER/weight of the coated product ranging between 3 and 10%.

The weight of the coated product will be equal to the sum of the weight of the eluent solution plus the weight of the decanted IER, plus that of the binder, wherein F' is equal to $$\frac{\text{dry } IER}{\text{decanted } IER + \text{eluant solution} + \text{hydraulic binder}}.$$

The following examples are given to illustrate the invention.

EXAMPLE 1

Taking a batch of borate-containing IER in suspension for treatment. Neither the composition of this batch, nor the exact nature of the IER, nor their borates content are known.

In actual fact, said IER contain 350 g eq $H_3BO_3$/kg of dry IER, which are anionic Amberlite IRN 78 LCL IER.

The batch of IER is placed into a mingler-mixer built by the company GUEDY, to which is coupled a weighing device. After a rest period during which the IER are allowed to decant, the supernatant solution is pumped out.

The apparatus is weighed, the weight of 100% decanted IER is determined.

30 l of aqueous solution of $Ca(NO_3)_2$ at 200 g/l are added to the obtained 16.5 kg of 100% decanted IER, together with 0.8 kg of solid lime, the resulting mixture being stirred for one hour.

75 kg of CLK cement are then added under stirring. The whole is mixed, then poured into a container under the normal conditions used for treating wastes with a hydraulic binder.

The weight of the resulting coated product is about 120 kg, this representing a rate of incorporation F' of 4% of dry resins, a ratio of total water/cement of 0.5 (total water = water of saturating solution + IER constituting water + interstitial water found in the 100% decanted IER) and a volume increase factor of 4.7.

Core samples are taken from said coated product and tested for mechanical strength.

Mechanical strength under compression is over 100 bars after 7 days, over 200 bars after 14 days, and over 300 bars after 2×28 days.

EXAMPLE 2

The same batch as before is decanted, weighed (16.5 kg) and eluted with 21.5 l of a 200 g/l aqueous solution of $Ca(NO_3)_2$ and 51 kg of CLK cement are added. We have then F' = 8% (in dry resin)

f = 3.5

Although incorporation is improved, hardening is reduced since compression strength is under 10 bars after 7 days, and over 200 bars after 28 days.

This process, which should be performed with a single apparatus composed of a mixer, and which is applicable to all IER used in nuclear medium, brings considerable simplification at the industrial level in the concreting of radioactive IER.

Therefore the process according to the invention offers a number of essential advantages for an industrial application in the nuclear field.

One of them is that it prevents the transfer of active materials: only the wastes to be treated are brought to the site. There is no need for any extraction, apart from the casting of the final product in a container, or for any parallel treatments of extracted effluents.

This because the whole of the treatment can be carried out in one single apparatus: the mixer.

The second advantage is the easy implementation of the process. For example, IER arrives, and nothing is known about it. It can be immobilized in a satisfactory way in conformity with the applicable safety standards. The only thing to do is to determine its weight in the decanted state and to remain withing the ranges of values prescribed by the process according to the invention.

As to elution, this is an easy operation.

Easy operations and simple apparatuses are sought in the nuclear field where the slightest problem raises difficulties as to man's intervention (manual handling on site) and as to the decontamination and the containment of the radioactive materials.

A third advantage is to be able to treat any type of IER originating from a nuclear installation, whether or not it contains borates, even in large quantity. Thereagain there is uniqueness in the treatment.

It should be noted that the ranges of F and F' are not essential features of the novel process of the invention and are merely the observed results obtained in the end product.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. A process for immobilizing, by a hydraulic binder, radioactive ion exchange resins which contain borates, said resins being in a suspension, comprising the steps of:

(a) decanting said resins 100%;

(b) placing the decanted resins in a vessel;

(c) adding to said vessel an eluant solution having between 100 and 300 grams per liter of $Ca(NO_3)_2$ with the proportion of eluant solution being from 1 to 2 liters per kilogram of said decanted resins;

(d) adding to said vessel a hydraulic binder of low hydration heat to said resins and eluant solution, the relative weight of the water of the eluant solution to the binder (by weight) being such that $$0.3 \leqq \frac{\text{water of the eluant solution (in weight)}}{\text{binder (in weight)}} \leqq 0.5; \text{ and}$$

(e) mixing the contents of said vessel, the percent (by weight) of the said resins, hereinafter referred to as dry resins, to the contents of the vessel being between 3% and 10%.

2. Process as claimed in claim 1, wherein in order to increase the efficiency of the elution and to obtain a pH ≧ 9, lime is added to the eluant solution in the proportion of 200 grams of lime per kilogram of the 100% of said decanted resins.

3. Process as claimed in claim 1, wherein the hydraulic binder is a slag cement.

4. Process as claimed in claim 3, wherein the slag cement contains at least 80% of clinker by weight.

5. A process for immobilizing radioactive ion exchange resins, which contain borates in a quantity which can be present in an amount of up to the equivalent of 1000 g $H_3BO_3$/kg of dry ion exchange resins, said resins being in a suspension, comprising the steps of:

decanting the ion exchange resins 100%;

placing the decanted ion exchange resins in a vessel with an eluant solution having one hundred to three hundred grams per liter of $Ca(NO_3)_2$ in the ratio range of one to two liters per kg of decanted ion exchange resins;

adding a low hydration heat hydraulic binder to said resins and eluant solution in said vessel so that the relative weight of the water of the eluant solution to the binder is $$0.3 \leqq \frac{\text{water of the eluant solution (in weight)}}{\text{binder (in weight)}} \leqq 0.5.$$

6. The process of claim 5 wherein said low hydration heat hydraulic binder is added in such a quantity that the percent by weight of ion exchange resins to the contents of the vessel, wherein said ion exchange resins are hereinafter referred to as dry resins, is between 3% and 10%.

7. The process of claim 5 wherein lime is added to the eluant solution in an amount sufficient to obtain a pH≧9.

8. The process of claim 2 wherein the hydraulic binder is a slag cement.

9. The process of claim 1 wherein step (e) further includes maintaining the contents of said vessel at a pH≧9.

10. The process of claim 1 wherein step (b) further includes weighting the resins in said vessel to determine the amount of eluant solution and binder to be introduced at steps (c) and (d).

11. The process of claim 1 wherein the contact between the eluant solution and the decanted resins in step (c) is maintained for a period of from one to three hours.

12. A process for immobilizing radioactive ion exchange resins which contain borates, said resins being in suspension, comprising the steps of:

(a) providing a vessel adapted to enable the vessel and its contents to be weighed;

(b) introducing the radioactive ion exchange resins into said vessel;

(c) decanting the ion exchange resins 100%;

(d) weighing said vessel and its contents to determine the weight of the decanted ion exchange resins;

(e) introducing into the vessel an eluant solution having in the range of from 100 to 300 grams per liter of $Ca(NO_3)_2$ in the ratio of 1 to 2 liters per kilogram of decanted ion exchange resins;

(f) stirring the contents of said vessel; and (g) adding a low hydration heat hydraulic binder into said vessel so that the relative weight of the water of the eluant solution to the binder is given by $$0.3 \leqq \frac{\text{water of the eluant solution (in weight)}}{\text{binder (in weight)}} \leqq 0.5.$$

13. The process of claim 12 wherein the contents of the vessel at step (e) are maintained in contact with one another for a period in the range of from one to three hours.

* * * * *

UNITED STATES PATENT AND TRADEMARK OFFICE

CERTIFICATE OF CORRECTION

PATENT NO. : 5,143,653

DATED : September 1, 1992

INVENTOR(S) : Magnin et al.

It is certified that error appears in the above-identified patent and that said Letters Patent is hereby corrected as shown below:

On the cover page insert the following:

--[30] Foreign Application Data
May 15, 1987 France..... 87.06871
May 11, 1988 PCT..... PCT/FR88/00233 --

Column 2, line 23, change "reductin" to --reduction--

Column 9, line 22, change "weighting" to --weighing--

Signed and Sealed this

Twenty-first Day of September, 1993

Bruce Lehman

*Attest:*

BRUCE LEHMAN

*Attesting Officer*

*Commissioner of Patents and Trademarks*